US006922540B2

(12) United States Patent
Yoshikawa et al.

(10) Patent No.: US 6,922,540 B2
(45) Date of Patent: Jul. 26, 2005

(54) DEVELOPER SUPPLY KIT

(75) Inventors: Junko Yoshikawa, Toride (JP); Yusuke Yamada, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/262,932

(22) Filed: Oct. 3, 2002

(65) Prior Publication Data

US 2003/0081967 A1 May 1, 2003

(30) Foreign Application Priority Data

Oct. 3, 2001 (JP) ..... 2001-307861

(51) Int. Cl.[7] ..... G03G 15/08

(52) U.S. Cl. ..... 399/262; 222/DIG. 1; 399/263

(58) Field of Search ..... 399/111, 119, 399/120, 252, 254, 256, 262, 263; 222/DIG. 1

(56) References Cited

U.S. PATENT DOCUMENTS

| | | | | | |
|---|---|---|---|---|---|
| 5,307,129 | A | | 4/1994 | Miura et al. | 399/263 |
| 5,557,382 | A | * | 9/1996 | Tatsumi et al. | 399/262 |
| 5,675,893 | A | | 10/1997 | Yamada et al. | 29/895.22 |
| 5,721,433 | A | | 2/1998 | Kosaka | 250/573 |
| 5,740,507 | A | * | 4/1998 | Ichikawa et al. | 399/262 |
| 5,890,040 | A | | 3/1999 | Matsuoka et al. | 399/262 |
| 5,907,750 | A | | 5/1999 | Yamada et al. | 399/116 |
| 5,991,571 | A | | 11/1999 | Yamada et al. | 399/117 |
| 6,151,472 | A | * | 11/2000 | Nakajima | 399/262 |
| 6,356,729 | B1 | | 3/2002 | Sasaki et al. | 399/258 |
| 6,389,257 | B1 | * | 5/2002 | Harumoto et al. | 399/262 |
| 6,405,010 | B2 | * | 6/2002 | Ashikari et al. | 399/262 |
| 6,438,345 | B1 | * | 8/2002 | Ban et al. | 399/262 |
| 2001/0044059 | A1 | | 11/2001 | Miyamoto et al. | 430/45 |
| 2002/0098436 | A1 | | 7/2002 | Miyamoto et al. | 430/110.3 |
| 2004/0131389 | A1 | * | 7/2004 | Tazawa et al. | 399/258 |

FOREIGN PATENT DOCUMENTS

| | | |
|---|---|---|
| JP | 7-44000 | 2/1995 |
| JP | 7-113796 | 12/1995 |
| JP | 8-136439 | 5/1996 |
| JP | 10-260574 | 9/1998 |
| JP | 2000-137351 | 5/2000 |
| JP | 2000-352840 | 12/2000 |

* cited by examiner

*Primary Examiner*—Hoan Tran
(74) *Attorney, Agent, or Firm*—Fitzpatrick, Cella, Harper & Scinto

(57) ABSTRACT

A developer supply kit for supplying a developer to an image forming apparatus includes a container for accommodating a developer; an opening provided in the container to permit discharging of the developer; and a feeding member, provided in the container, for feeding the developer by rotation thereof. The feeding member includes a lift portion for lifting the toner in the container, a guiding portion for guiding the toner lifted by the lift portion downwardly toward the opening, and a falling portion for letting the toner lifted by the lifting portion fall without feeding it toward the opening with rotation of the feeding member. The developer has an adhering strength which is not less than 0.60 g/cm$^2$ and less than 3.00 g/cm$^2$ after a vertical pressure of 128.4 g/cm$^2$ is imparted to a layer of the developer.

44 Claims, 7 Drawing Sheets

DEVELOPER SUPPLY KIT

FIELD OF THE INVENTION AND RELATED ART

The present invention relates to a developer supply kit for supplying a developer to an image forming apparatus, such as a copying machine, a printer, a facsimile machine or the like, which forms an image using an electrophotographic-type or electrostatic recording-type process.

Conventionally, fine powder toner is used as a developer in the image forming apparatus such as a copying machine, a printer or the like, using an electrophotographic-type method. When the developer of the main assembly of the image forming apparatus is consumed, the developer is supplied into the image forming apparatus, using a developer supply container.

Since the toner is very fine particles, there is a problem that during the developer supply operation, the developer is scattered with the result of contamination of the operator or the ambient environment. A proposal has been made as to a type of device wherein the developer supply container is kept placed in the main assembly of the image forming apparatus, and the developer is gradually supplied through a small opening. In such a type of device, it is difficult to let the developer discharge by the gravity, and therefore, a developer stirring means and feeding means are required.

The developer supply container disclosed in Japanese Patent Application Publication Hei 7-113796 is generally substantially cylindrical, and a relatively small opening for developer discharging is formed at one end portion thereof. A developer stirring feeding member in the form of a screw is provided in the container, and it penetrates an end wall of the container to receive a driving force from outside of the container. The end of the stirring member opposite the driving side is a free end.

A developer supply container disclosed in Japanese Laid-open Patent Application Hei 7-44000, is generally in the form of a cylindrical bottle, which is provided with a helical projection and a small discharge opening for permitting discharge of the developer adjacent the center of one end of the container, and an extension at the end portion having the discharge opening. By rotation of the main assembly of the developer supply container, the developer is fed to the discharge opening side end by the helical projection and is guided by the extension adjacent the opening at the axial end portion, and is raised to the opening adjacent the center of the container, and is discharged to the outside the container.

The developer supply container disclosed in Japanese Laid-open Patent Application Hei 10-260574 is in the form of a generally cylindrical bottle, which is provided with a helical projection inside thereof and a small discharge opening adjacent the center of one end. The bottle further comprises a paddle for lifting the developer fed to the discharge opening side end by the helical projection and a guiding portion for guiding the lifted developer to the discharge opening.

The containers disclosed in Japanese Laid-open Patent Application Hei 7-44000 and Japanese Laid-open Patent Application Hei 10-260574 are not provided with a stirring member within the main body of the container, and therefore, they are free of a problem arising from the stirring shaft reception, for example, the problem that developer is stuck in the bearing seal portion of the stirring member. However, they are provided with a helical projection inside the main assembly of the container, and therefore, there arises the following problem.

Since the helical projection is projected from the inner surface of the container, the inside volume of the container is reduced correspondingly. This becomes particularly remarkable if the developer feeding power is enhanced, since then, the height of the helical projection has to be increased. In addition, the high projection results in difficulty in filling the developer into the container.

Since the helical projection exists substantially over the entire inner surface of the container, there is a tendency that developer stagnates at the base portion of the helical projection. When the developer is agglomerated in the main body of the developer supply container due to vibration during transportation or by being left under high temperature and high humidity conditions for a long term, there is no trigger for loosening the agglomeration. Then, the developer feeding performance is adversely affected. In the case of toner exhibiting a high adherence and/or agglomeration, the above-described tendency is remarkable, and the developer usable with the container is limited.

With this structure in which the developer is supplied from an end of the container without use of the stirring shaft, it is considered that the flowability index or the ability of the developer to agglomerate significantly influences the developer feeding power.

Accordingly, some proposals have been made as to a developer supply kit having in combination a structure of a developer supply container and developer properties.

For example, particularly Japanese Laid-open Patent Application 2000-352840 discloses a combination of a particle size distribution and the structure of the container.

As another example, Japanese Laid-open Patent Application 2000-137351 proposes a combination of toner and a rotary type toner supply container not having an agitator in consideration of the circularity of the toner.

However, the important problem with the developer supply kit having such a structure is the developer discharging property when the developer is agglomerated in the main assembly of the developer supply container due to the vibration during transportation or due to being left under high temperature and high humidity conditions for a long term.

The phenomenon is not particularly related to the properties such as the circularity of the toner or the particle size distribution, and the property to be noted relates to the compressing of the toner to a certain degree, and therefore, the average particle size and/or the circularity are insufficient alone to solve this problem.

SUMMARY OF THE INVENTION

Accordingly, it is a principal object of the present invention to provide a developer supply kit, wherein the feeding power for a developer is high, and a stabilized discharging rate can be maintained from the initial stage to the last stage of use.

It is another object of the present invention to provide a developer supply kit wherein the developer can be supplied out of its container substantially completely.

It is a further object of the present invention to provide a developer supply kit in which the developer feeding power is maintained even when the developer is agglomerated in the main body of the developer supply container due to vibration during transportation or due to being left under high temperature and high humidity conditions for a long term.

It is a further object of the present invention to provide a developer supply kit in which scattering of the developer and contamination with the developer is minimized adjacent the opening of the developer supply container.

It is a further object of the present invention to provide a developer supply kit in which the opening of the developer supply container is not plugged with the developer under a wide range of ambient conditions.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A description will be provided as to a toner supply kit comprising toner (developer) and a toner supply container (developer supply container) referring to the accompanying drawings. Dimensions, materials, configurations, relative dispositions and the like of the constituent elements in this embodiment do not limit the present invention unless particularly mentioned.

(Embodiment 1)

Figure 8:
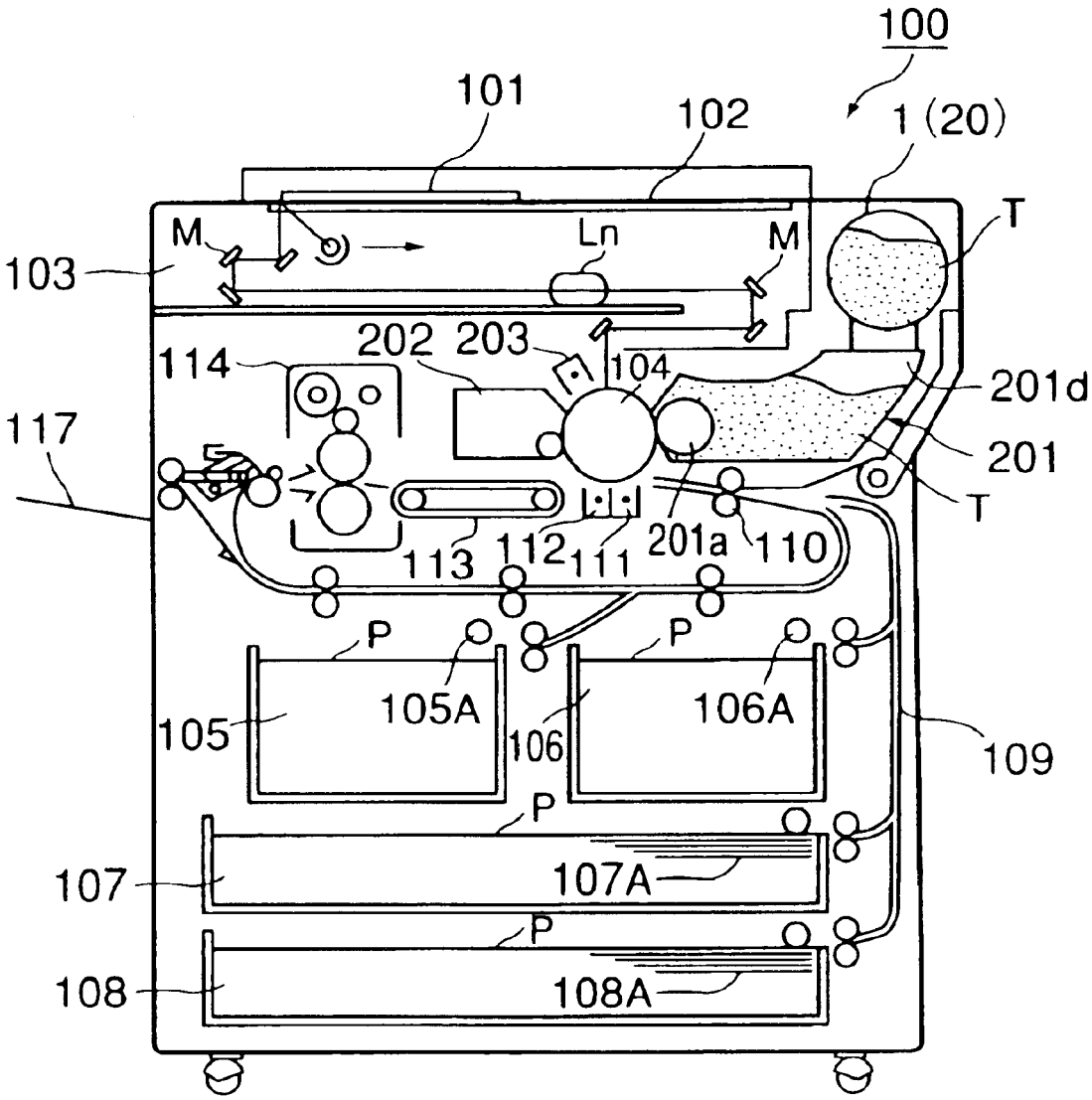
FIG. 8 is an example of an image forming apparatus to which the present invention is applicable.

FIG. 8 is a longitudinal sectional view of an electrophotographic image forming apparatus 100 which is an exemplary image forming apparatus into which the developer supply kit of the present invention can be mounted.

An operator places an original 101 on an original supporting platen glass 102. A light image of the original is formed on a photosensitive drum 104 (image bearing member) which is electrically charged by primary charging means 203 through a plurality of mirrors M and a lens Ln constituting an optical portion, so that an electrostatic latent image is formed on the photosensitive drum 104.

Around the photosensitive drum 104, there are provided a developing device 201, cleaning means 202, a primary charging means 203, which constitute an image formation station. The developing device 201 develops the electrostatic latent image into a toner image on the photosensitive drum 104 using toner T (developer).

On the other hand, recording materials P (sheets of paper, OHP sheets or the like) are stacked on feeding cassettes 105, 106, 107, 108. A sheet P having a size determined on the basis of information inputted by the operator at an operating portion (unshown), is selected. One of the rollers, among the pick-up rollers 105A, 106A, 107A, 108A, provided for the feeding cassette accommodating the selected sheet, is rotated. The sheet P fed from the sheet feeding cassette 105, 106, 107 or 108 is fed to the registration rollers 110 by way of a feeding portion 109.

The registration roller 110 functions to feed the sheet P to the photosensitive drum 104 in synchronism with the rotation of the photosensitive drum 104 and the scanning timing of the optical portion 103. The toner image is transferred from the photosensitive drum 104 onto the sheet P by transferring means 111. Thereafter, the sheet P is separated from the photosensitive drum 104 by separating means 112. The sheet P is fed to a feeding portion 113 and to a fixing portion 114. The toner image is fixed on the sheet P by heat and pressure at the fixing portion 114. The sheet P is discharged to a tray 117.

In the electrophotographic image forming apparatus 100 having such a structure, a developer supply container 1 for supplying the toner (developer) into the developing device 201 is detachably mounted in the main assembly 100 of the apparatus. It is disposed above the developing device 201.

The toner T discharged through the opening of the developer supply container 1 is supplied into the developing container 201*d* of the developing device 201 by an unshown feeding mechanism. The developing device 201 has a developing roller 201*a* which is disposed with a small gap (approx. 300 $\mu$m) from the photosensitive drum 104. The toner T is supplied to a surface of the developing roller 201*a*. During the developing operation, the developing roller 201*a* is supplied with a developing bias voltage, by which the toner moves to the photosensitive drum 104 to develop the electrostatic latent image into a toner image on the photosensitive drum 104.

The cleaning means 202 functions to remove the toner remaining on the photosensitive drum 104 after the toner image is transferred onto the sheet. The toner T consumed by the developing operation is sequentially replenished from the developer supply container 1.

Figure 1:
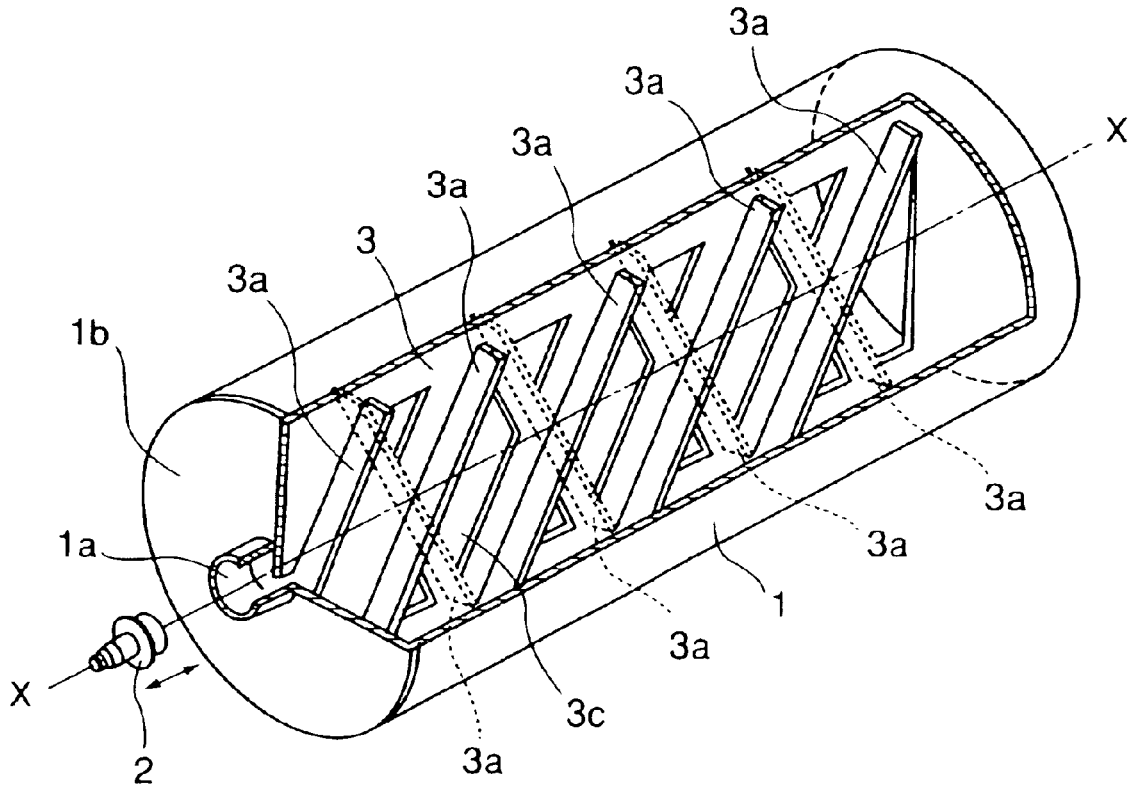
FIG. 1 is a perspective view of a partial section of an example of the developer supply container according to an embodiment of the present invention.
Figure 2:
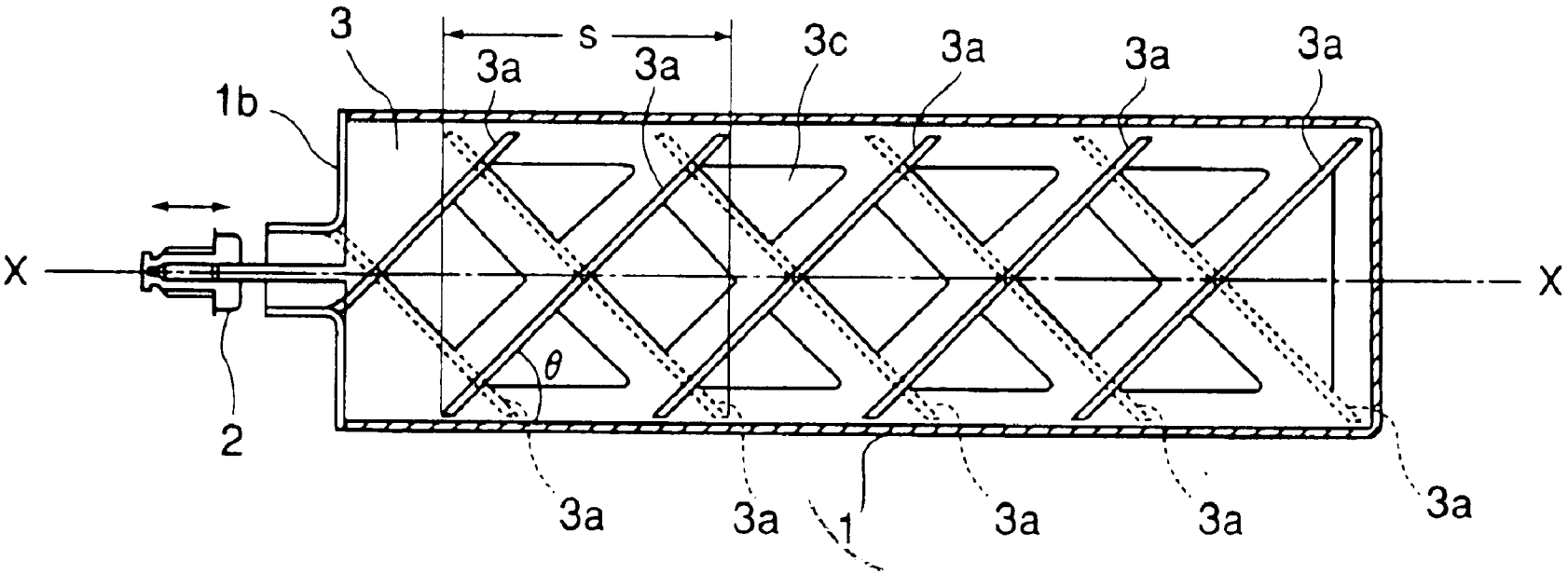
FIG. 2 is a longitudinal sectional view of an example of a developer supply container according to an embodiment of the present invention.

Referring to FIGS. 1 and 2, a description will be provided as to the developer supply kit according to an embodiment of the present invention, comprising a developer supply container 1 and the developer T including toner therein.

FIG. 1 is a perspective view of a partial section of a developer supply container 1 in this embodiment, and FIG. 2 is a longitudinal sectional view.

As shown in FIGS. 1 and 2, the main assembly 1 or bottle of the container is substantially cylindrical, and is provided in one end surface with a circular opening la having a diameter smaller than that of the cylindrical portion. The opening is formed by an extended portion of the end. In this embodiment, the inner diameter of the opening 1*a* is approx. 1/7 of the inner diameter of the main body of the container.

The opening 1*a* is provided with a sealing member 2 for plugging the opening la, and the sealing member 2 is slidable relative to the main body of the container 1 in an axial direction indicated by an arrow to open and close the opening 1*b*. When it is mounted to the image forming apparatus 100, the container is horizontally oriented such that axis X—X direction is perpendicular to a moving direction of the sheet P, and is inserted into the main assembly with the opening 1*a* at the leading side, so that opening 1*a* side is placed at the rear of the main assembly.

The size of the opening 1*a* is an important factor influential to the toner (developer) discharging speed. If the opening 1*a* is enlarged, the discharging amount (rate)

increases correspondingly. If, however, it is too large, the developer tends to easily flush out at the opening 1*a* with the result of contamination adjacent the opening 1*a*. Particularly, the tendency is remarkable immediately after the sealing member 2 is removed from the opening 1*a*. If it is too small, the discharging amount is not sufficient, and the toner may plug the opening.

From various investigations, it has been found that the equivalent inner diameter of the opening 1*a* is preferably 1/20–1/3 of the inner diameter of the cylindrical portion of the main body 1 of the container.

A description will be provided as to the inside structure of the developer supply container 1.

The main body 1 is substantially cylindrical, and is substantially disposed horizontally in the image forming apparatus 100, and the bottle 1 (main body) of the container is rotated by the main assembly 100 of the apparatus.

In the bottle 1, a partition wall 3 (feeding member) is extended substantially the full length of the container so as to divide the inside space into two parts. The opposite sides of the partition wall 3 are provided with a plurality of projections 3*a* disposed in a mirror symmetric relation with respect to the rotational axis X—X of the main body 1 of the container, the projection 3*a* having surfaces inclined relative to the direction of the axis. The partition wall 3 has a proper number of through hole portions 3*c* penetrating through the partition wall 3, the number and the sizes thereof being proper to permit the developer to move across the partition wall 3.

The inclination angle of the inclined projection portion 3*a* shown in FIG. 2 is an important factor influential to a feeding performance of the developer. With the structure of the present invention, the inclination angle is 30°–75° and preferably 45°–70°. In this embodiment, the inclination angle θ of the projection 3*a* is approx. 45°.

If the inclination angle θ is larger than 75°, the developer falls on the inclined surface of the inclined projection portion 3*a* more like vertical drop, so that the feeding amount of the developer is larger because the developer slides more, but the feeding distance s per one inclined projection portion 3*a* is shorter, so that feeding speed is slower.

If the inclination angle θ is less than 30°, the feeding distance s per one inclined projection portion 3*a* is longer, so that feeding the speed is higher, but if the angle is too small, the developer does not easily fall on the inclined projection portion 3*a*.

By selecting the inclination angle θ, a desired developer feeding power can be used.

An end of the inclined projection 3*a* is extended to reach the opening 1*a*, and therefore, the developer is discharged finally through the opening 1*a* by the projection 3*a*. As shown in FIGS. 1 and 2, the projections 3*a* are arranged on the front and back surfaces of the partition wall 3 symmetrically with respect to the rotational axis X—X such that developer is fed by a unidirectional rotation.

Figure 3:
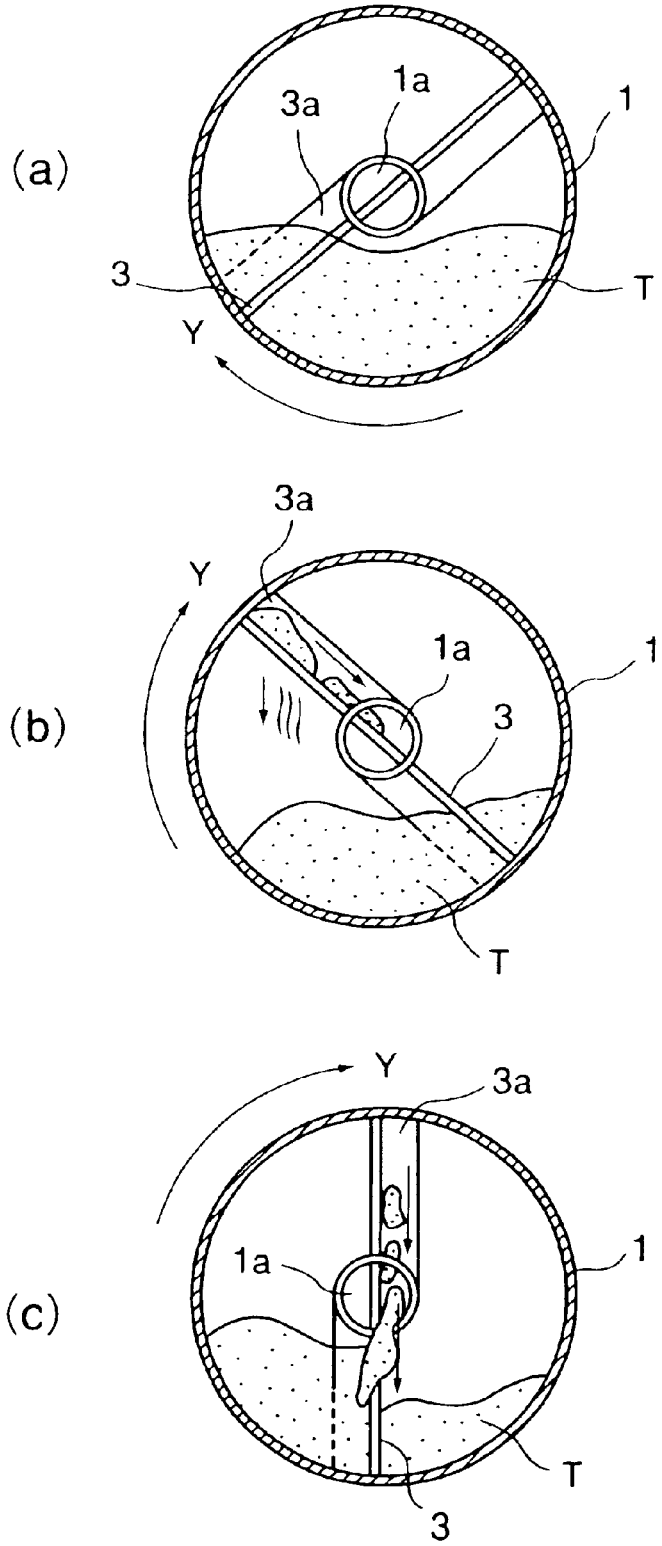
FIGS. 3(*a*)–3(*c*) illustrate the behavior of the developer in the developer supply container during transportation in an embodiment of the present invention.

Referring to FIGS. 3(*a*)–3(*c*), a description will be provided as to the developer discharging principle of the developer supply container 1. When the main body 1 of the container rotates in the direction indicated by arrow Y, as shown in FIG. 3(*a*), the developer T, with the rotation, is gradually lifted by a lifting portion (the portion partition wall capable of lifting the developer T against gravity). When the position shown in FIG. 3(*b*) is reached, the developer T lifted by the lifting portion is either fed toward the front side of the main body 1 of the container (toward the opening) by the inclined projection portions 3*a* by gravity or falls through the hole portions of the partition wall to the back side. Thus, the developer is fed and stirred, and therefore, the developer discharged through the opening is in good order. The developer not lifted by the lifting (scooping) portion, passes through the hole portions, by which the developer is stirred together with feeding.

By repeating the operation, as shown in FIG. 3(*c*), the developer T in the main body 1 of the container is stirred and sequentially fed toward the discharge opening, and at the last stage, the developer T is fed to the opening 1*b* by the inclined projection portion 3*a* extending to the opening 1*a*, and then the developer T is discharged through the opening 1*a*.

The inclined projection portions 3*a* are projected from the partition wall 3, and therefore, the agglomeration of the developer T can be loosened when the toner bottle 1 is rotated. The loosened developer T is fed toward front side by the inclination of the inclined projection portion 3*b*. In this manner, the two functions (stirring and feeding) are simultaneously performed.

With this structure, there is no stirring member in the bottle 1, and therefore, there is no risk of producing coarse granulation which may be produced in stirring shaft receiving portions.

Furthermore, the developer is efficiently fed by the partition wall and the inclined projection portion 3*a*, and the discharging amount is relatively constant.

By the provision of the hole portions 3*c* penetrating the partition wall 3, the developer is given flowability, and therefore, the feeding power is good. However, if the hole portion 3*c* is too large, or the number of the hole portions 3*c* is too large, the developer cannot be scooped by the partition wall 3. In view of this, a proper number and a proper size are selected.

The inclined projections are partly overlapped as seen in the direction perpendicular to the rotation axis, that is, when they are projected onto the rotation axis. By doing so, the toner advanced toward the opening by an inclined projection is then further advanced by an inclined projection disposed immediately in front of the inclined projection. Thus, the toner is efficiently stirred and fed.

As compared with a container having a helical projection on an inner surface, the toner container 1 of this embodiment exhibits a high stirring effect for the developer by the inclined projection portion 3*a*, and therefore, the flowability is enhanced in the bottle 1.

By the provision of the partition wall 3, the bottle 1 is reinforced.

However, with the structure of such a toner supply container 1, there is no stirring member or the like in the main assembly 1 of the container. When the container is subjected to vibration during transportation, or it is kept in high temperature and high humidity conditions for a long term, the toner may be agglomerated in the main assembly 1 of the container, that is, the toner is caked (a so-called toner bridge is formed). If this occurs, the toner is not uncaked since no stirring member is provided, and therefore, that is a liability that the discharging property becomes unsatisfactory. Particularly, when the developer exhibiting a high deposition property and a agglomeration property is used, this problem is remarkable. Thus, the intended function of the developer supply container is not properly performed with such a developer.

When the developer exhibiting the high deposition property and/or agglomeration property is subjected to vibration during transportation or is kept under the high temperature and high humidity for a long term, the developer T is deposited to the container body at the opening 1*a* (discharge opening) or is agglomerated there with the result of the formation of a narrowed passage of the developer at the opening 1*a*, thus remarkably deteriorating the discharging property.

In consideration of these factors, the powder properties of the developer T suitable for the developer supply container 1 (developer supply kit) have been investigated.

Generally speaking, as for a reference exhibiting the adherence and the agglomerativeness of the developer T, the agglomerativeness is determined by a ratio of powder, remaining on a sieve, of the powder place on the sieve and vibrated. However, the agglomerativeness determined in this manner does not properly function as an index when the developer feeding property, and the discharging property of the developer supply container are considered, because such an agglomerativeness is a property at the time when the developer is given the flowability by the vibration which is inevitable for the determination of such an agglomerativeness.

As a result of investigations and considerations, it has been found that the adherence property and the shear property of a powder layer of the developer placed in a state sealed to a certain extent are significantly influential.

Here, the powder layer of the developer is a toner powder layer when the developer comprises toner only, and when the developer comprises toner and carrier, it is a layer of the mixture (powder).

As indices indicative of the adherence property and the shear property of the powder layer in the developer, the adhering strength and the shear index of the powder are particularly noted, and by combining a container with the developer having such properties within predetermined ranges, a developer supply kit with which the advantageous effects of the above-described type of the developer auxiliary connection container are maximum in a synergism, can be provided.

The measuring method of an adhering strength and a shear index in the present invention will be described. By using the developer described below with the developer supply container, the stirring, and the feeding of the developer is satisfactory from the initial stage of the use of the developer supply kit. Thus, a developer supply kit of high reliability can be provided.

For the measurement, a powder bed tester (tradename, PTHN-13BA type, available from Sankyo Dengyo Kabushiki Kaisha, Japan) was used.

A weight is placed on a powder layer T2 of the developer T for 10 minutes such that the perpendicular weight to the powder layer T2 is 128.4 g/cm$^2$, thus compressing the powder layer T2, and then, the following two measurements are carried out for the compressed powder layer T2 of the developer T. In the measurements, it is preferable that the thickness of the powder layer T2 on the supporting table 42, is not less than about 1 cm, and in this embodiment, the thickness thereof is approx. 1 mm. The measurements are carried out under a temperature of 23° C. and a relative humidity of 50%.

As for the applied perpendicular weight, the investigations have been made to find a bulk density of the developer T which represents the state provided by compression by the transportation or by being left on a shelf. As a result, it has been empirically found that a representative state can be provided by a 10 minute compression under 128.4 g/cm$^2$.

The duration of application of the pressure is not inevitably 10 minutes, and may be changed for the determination of the adhering strength and the shear index if a plurality of measurements of each of the tensile strength and shear strength are substantially uniform, that is, if the duration is sufficient to saturate the compressed state of the powder layer. In this embodiment, the tensile strength and the shear strength are measured a plurality of times, respectively, and the adhering strength and the shear index are determined as respective averages.

Figure 4:
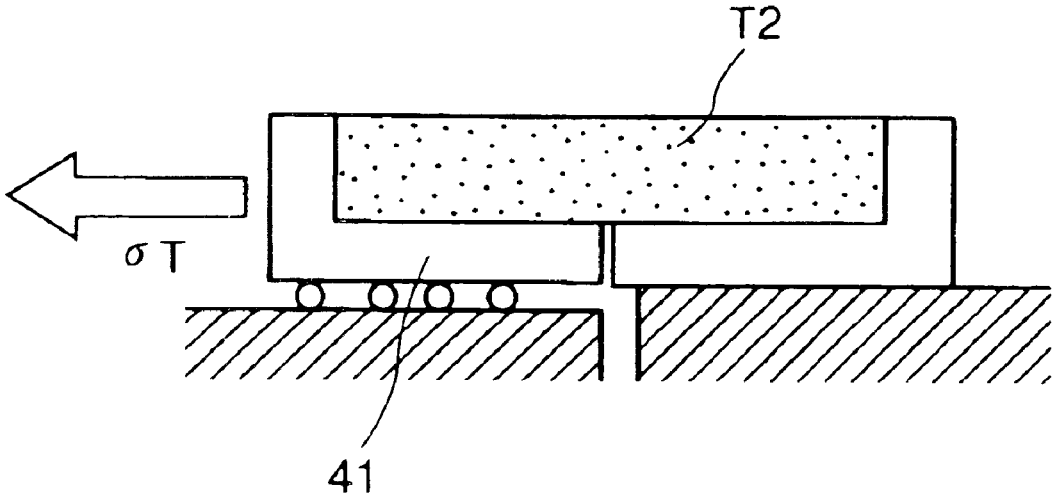
FIG. 4 is an illustration of a measuring method of the adherence strength and the shear index of the developer.

More particularly, as shown in FIG. 4, a movable cell 41 accommodating the powder layer T2 of the developer T therein is pulled in a horizontal direction, and the tensile stress σT at which the powder layer T2 in the movable cell 41 is ruptured is measured (the powder layer T2 is broken substantially into two parts in the horizontal direction).

Figure 5:
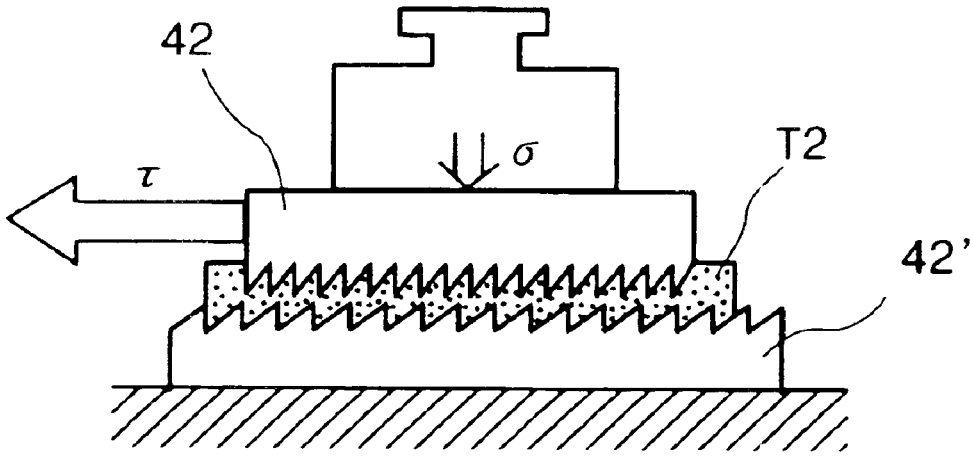
FIG. 5 is an illustration of a measuring method for determining the adhering strength and the shear index of the developer in an embodiment of the present invention.

Then, as shown in FIG. 5, the powder layer T2 is sandwiched between a supporting table 42' (made of a stainless steel) and a movable plate 42 (made of aluminum), the supporting table 42' and the movable plate 42 having notches on the upper and lower sides, respectively. The movable plate 42 is moved in a horizontal direction while applying a vertical stress σ to the powder layer T2 from the upper side, thus shearing the powder layer T2 (the powder layer T2 is sheared into two parts substantially along a horizontal plane). The shear strength τ is measured twice with different normal stress as to obtain τi (τ1, τ2). The shear stress once tends to increase at the initial stage of the horizontal movement of the movable plate, and then, to decrease toward a certain level (stable state). In this embodiment, the initial value at which the horizontal movement of the movable plate begins is taken as the shear strength.

The adhering strength τO and the shear index n are calculated by the Warren Spring equation, which relates the measured tensile strength σT, the first shear strength τ1 (with the normal stress of σ1) and the second shear strength τ2 (with the normal stress of σ2), as follows:

$$(\tau_i/\tau_o)n=(\sigma_i+\sigma_T)/\sigma_T(i=1, 2) \quad . . . (2).$$

The movable plate 42 used in the measurement of the first shear strength τ1 has the following notches:

Height of the notches is 1 mm: and

Intervals of the notches are 1.5 mm:

The adhering strength τ of the powder layer T2 of the developer, determined through the above-described measuring method, is preferably as follows: The adhering strength with vertical pressure of 128.4 g/cm$^2$ is not less than 0.60 g/cm$^2$ and not more than 3.00 g/cm$^2$.

If the adhering strength is less than 0.60 g/cm$^2$, the developer T tends to flush through the opening 1*a* of the developer supply container 1 with the result of contamination of the neighborhood of the connecting portion between the opening 1*a* and the developing device with the developer.

Particularly, immediately after removing the sealing member 2 from the opening 1*a* of the developer supply container 1, a great amount of the developer T is discharged despite no discharging operation being carried out (flushing). In addition, at the time when the developer T is filled into the container 1, the developer T powder does not sink quickly, that is, the apparent bulk density does not decrease quickly, and therefore, the developer filling is difficult in the manufacturing.

If, on the other hand, the adhering strength is not less than 3.00 g/cm$^2$, the developer T tends to agglomerate, with the result that developer T may plug the opening 1*a* of the container 1, and therefore, the possibility of no developer discharge is high. In addition, the amount of the developer T deposited on the inner wall or the inclined projection portion 3*a* of the container 1 is large, with the result that the amount of the developer T unusably remaining in the container is large.

Therefore, the shear index of the developer T with the vertical pressure of 128.4 g/cm$^2$ is 1.02–5.00.

When the shear index is less than 1.02, the developer T tends to flush through the opening 1*a* of the developer supply container 1 with the result of contamination of the neighborhood of the connecting portion between the opening 1*a* and the developing device with the developer. Particularly, immediately after the sealing member 2 is removed from the opening 1*a* of the developer supply container 1, a great amount of the developer T may flush out.

In the case of the structure of the container, the developer T slides on the inclined projection portion 3*a* by which the developer T is fed. When the shear index is not less than 5.00, the developer T cannot efficiently slide on the inclined surfaces of the projections 3*a*, and therefore, the feeding performance is deteriorated. In addition, the discharging speed is slow, and the amount of the developer T unusably remaining on the inner wall or the inclined projection portion 3*a* of the container 1 is large. Furthermore, in the case that developer is agglomerated in the main assembly of the container after it is subjected to vibration during the transportation or after it is placed under high temperature and high humidity conditions for a long term, the agglomerated masses of the developer does not loosen at all despite the rotation of the container, and therefore, the developer cannot be discharged.

As for a method of providing the adhering strength of 0.60 g/cm$^2$–3.00 g/cm$^2$ with the vertical pressure of 128.4 g/cm$^2$, and a method of providing the shear index of 1.02–5.00, any known method is usable. In an example of the method, the flowability is given by externally adding to the toner particles at least one of hydrophobic (processed for hydrophobicity) silica fine particles, alumina fine particles and titanium oxide fine particles to suppress the agglomerativeness and the adherence of the toner.

Since the flowability application material has been treated for the hydrophobic nature, the influence of the moisture can be avoided even under high temperature and high humidity conditions, and therefore, the agglomeration can be prevented. In addition, the stabilized charging performance can be maintained for a long term irrespective of the ambience.

The average particle size of the primary particle of the flowability application material is preferably 1–100 nm, and further preferably 4–80 nm.

If it is smaller than 1 nm, they tend to be implanted into the surface of the toner of the developer when they are externally added, and therefore, the adherence and the agglomerativeness are so high that an image transfer defect may occur in the image forming process. If it is larger than 100 nm, the agglomerativeness of the toner is so high that toner particles are not uniformly charged with the result of electrostatic agglomeration, the production of a foggy background in the resultant image, and toner scattering.

The amount of the externally added fine particle, such as a flowability application material, is preferably 0.035 parts by weight on the basis of 100 parts by weight of the toner particles. With the external addition in this range, there is provided an appropriate surface coverage ratio so that agglomeration of the toner particles can be suppressed.

A primary average particle size of the flowability application material is measured in the following manner. The flowability application material is observed by a transmission electron microscope, and the particle diameters of 100 particles having a size not less than 1 nm in the view field are measured, and they are averaged.

The method of producing such toner may be a pulverization method in which the component materials are mixed and pulverized, as will be described in Embodiment 2, or a polymerization method using a solvent. In this embodiment, the following non-magnetic toner A produced by a pulverization method is employed.

Toner A:

Polyester resin material: 93 parts by weight

Wax: 5 parts by weight

Copper phthalocyanine: 7 parts by weight

Electrification control material: 2 parts by weight

These materials are preliminarily mixed in a powder mixer, and then are heated, melted and mixed by a biaxial extruder. The melted and mixed material is cooled, and then is coarsely pulverized into approx. 1–2 mm particles using a hammer mill, and thereafter, they are finely pulverized by a fine particulating machine of an airjet type. The fine particles are classified by a classifying apparatus into multiple classes with strict removal of the too fine or coarse powder, so that cyan toner particles are produced. The fine particles are classified by a classifying apparatus into multiple classes with strict removal of the too fine or coarse powder, so that cyan toner particles are produced. The cyan toner particle had a volume average particle size of 8.5 $\mu$m.

A Henschel mixer is used to externally add hydrophobic (processed for hydrophobicity) titanium oxide at a ratio of 0.8 parts by weight of the hydrophobic titanium oxide having an average diameter of 5 nm on the basis of 100 parts by weight of the cyan toner particles, thus providing cyan toner A.

The adhering strength of the powder layer of the toner A with the vertical pressure of 128.4 g/cm$^2$ was 2.3 g/cm$^2$, and the shear index was 3.37.

The content of the added wax was 5.4 parts by weight on the basis of 100 parts by weight of binder resin material.

The developer T (toner A) is filled into the developer supply container 1 having the structure shown in FIGS. 1 and 2, having been described hereinbefore. It is mounted in the image forming apparatus 100 shown in FIG. 8 and is rotated. It has been confirmed that the developer discharging property was satisfactory from the beginning of the discharging and substantially all of the developer T is discharged with very small amount of the remaining developer T, and in addition, there is hardly any developer T deposited in the inner wall of the container 1.

Even in the case that developer T is agglomerated into blocks because of high humidity conditions or the like, the blocking is immediately loosed after the start of rotation of the container 1, so that a satisfactory discharging property results. There is hardly any plugging by the developer T in opening 1*a*. Substantially all of the developer T is discharged out, and the amount of the remaining developer T is very small, and there is hardly any developer T deposited on the inner wall of the container 1.

(Comparison Example 1)

A description will be provided as to toner F produced by a pulverization method as a comparison example. The content of the wax in the toner F is 10 parts by weight relative to the binder resin, but to the toner F is not added the flowability application material, such as hydrophobic titanium oxide, added to the toner A.

Toner F:

Styrene-acrylic resin material: 100 parts by weight:

Magnetic particles-having an average particle size of 0.05 μm: 90 parts by weight Wax: 10 parts by weight These component materials are preliminarily mixed in a powder mixer, and then are heated, melted and mixed by a biaxial extruder. The melted and mixed material is cooled, and then is coarsely pulverized into approx. 1–2 mm particles using a hammer mill, and thereafter, they are finely pulverized by a mechanical pulverising apparatus. The fine particles are classified by a classifying apparatus into multiple classes with strict removal of the too fine or coarse powder, so that cyan toner particles are produced. The fine particles are classified by a classifying apparatus into multiple classes with strict removal of the too fine or coarse powder, so that toner particles are produced. The magnetic toner particles had a volume average diameter of 9.8 μm.

A Henschel mixer is used to externally add titanium oxide having a primary average diameter of 120 nm at a ratio of 0.5 parts by weight of the titanium oxide having an average diameter of 5 nm on the basis of 100 parts by weight of the cyan toner particles, thus providing the toner F.

The adhering strength of the powder layer of the toner F with the vertical pressure of 128.4 g/cm$^2$ determined in the above-described manner, was 8.8 g/cm$^2$, and the shear index was 6.9, which was out of the range of the above-described embodiment of the present invention.

The developer T (toner A) is filled into the developer supply container 1 having the structure shown in FIGS. 1 and 2, having been described hereinbefore. It is mounted in the image forming apparatus 100 shown in FIG. 8 and is rotated. It has been confirmed that amount of unusably remaining developer was not less than approx. 10%. Even in the case that developer T is agglomerated into blocks because of high humidity conditions or the like, the blocking is immediately loosed after the start of rotation of the container 1, so that a satisfactory discharging property results.

When the developer T is agglomerated into blocks because of high humidity conditions or the like, the blocking is not loosened until 5 or more minutes rotation of the container. In addition, the discharging speed is very slow even after the blocked toner is loosened.

As will be understood from the comparison between the toner A of this embodiment and the toner F of the comparison example 1, the adhering strength of the powder layer is preferably within the above-described range, namely, 0.60 g/cm$^2$–3.00 g/cm$^2$ with the vertical pressure of 128.4 g/cm$^2$.

Since the toner A contains the flowability application material, such as hydrophobic titanium oxide, which is not contained in the toner F, the adhering strength and the shear index under the state compressed at a predetermined pressure can be lowered into the above-described range.

From the foregoing, if the adhering strength of the powder layer of the developer with the vertical pressure of 128.4 g/cm$^2$ is sweeping the range of 0.60 g/cm$^2$–3.00 g/cm$^2$, the proper developer feeding performance in the developer supply container can be maintained at a proper level, irrespective of the ambient conditions. In order to provide the adherence strength and shear index within the range, the addition of the flowability application material is effective, the material being at least one of hydrophobic silica having an average particle size of 1–100 nm, hydrophobic titanium oxide and hydrophobic (processed for hydrophobicity) alumina.

The developer supply container 1 suitable for the developer supply kit is preferably as follows.

(1) The shape is cylindrical, by which the developer can smoothly move on the inner surface of the container, and therefore, the feeding performance of the developer is good enough to reduce the amount of the developer which unusably remains in the container.

(2) The opening is provided on a rotation axis of the main assembly of the container at one axial end of the main body, and therefore, the scattering of the developer or the contamination with the developer is not significant in the neighborhood of the opening of the developer supply container. Since the opening is circular, the sealing property of the sealing member for sealing the opening is high, the leakage of the developer hardly occurs. In addition, since the inner diameter of the opening of the container is 1/20–1/3 of the inner diameter main assembly of the container, the developer does not leak through the opening, and the flushing of the developer can be prevented. Additionally, the developer feeding speed can be controlled at a proper level.

(3) At least one of a projection provided on the partition wall has a portion connecting to the opening, and therefore, the developer can be assuredly fed into the opening.

(4) The inclination angle of the inclined projection is in the range of 30—75-, and therefore, the proper developer feeding performance can be assuredly maintained. By adjusting the inclination angle within this range, the desired developer feeding power can be provided.

(5) The partition wall is provided with a through opening, and therefore, the stirring effect for the developer inside the developer supply container is enhanced, and the flowability is enhanced. This further improves the feeding performance of the developer, so that the amount of the unusably remaining toner can be reduced.

The developer supply container 1 of this embodiment having the features (1)–(5) is one example which is preferable for the developer supply container of this kind. The present invention is applicable to a developer supply container including a main assembly having an opening for permitting discharging of the developer, a partition wall extending continuously in the rotational axis direction in the container and dividing the space in the main body into a plurality of parts, and a projection projected from the surface of the partition wall and having a surface inclined with respect to the axis.

The developer supply kit accommodating the developer, such as toner A, which has an adhering strength (powder layer) with a vertical pressure of 128.4 g/cm$^2$ is 0.60 g/cm$^2$–3,00 g/cm$^2$, is inexpensive, and no coarse particles are produced when it is used with the image forming apparatus 100 shown in FIG. 8.

In addition, the feeding power of the developer is satisfactory, and a proper level of the discharging rate is maintained in the latter stages of the developer discharge, while using a repeatedly usable and highly reliable developer supply container.

Moreover, the amount of the developer unusably remaining in the developer supply container or the developer deposited on the inner wall container can be minimized, so that substantially all of the developer in the developer supply container can be used up.

Furthermore, even when the developer is agglomerated in the main assembly of the developer supply container and caked as a result of vibration during transportation or being kept under high temperature and high humidity conditions for a long term, the developer can be loosened by a smaller external force to maintain the proper feeding power for the developer. Thus, the stabilized amount of the discharge can be maintained until the developer is used up.

Additionally, the scattering of the developer and the condemnation with the developer in the neighborhood of the opening of the developer supply container can be minimized, so that the opening is effectively prevented from being plugged with the developer under any ambient conditions.

The shear index of the powder layer of the developer accommodated in the above-described developer supply container, is preferably 1.02–5.00 with the vertical pressure of 128.4 g/cm$^2$.

(Embodiment 2)

This embodiment is directed to a method for providing such a developer that the powder layer thereof has an adhering strength of 0.60 g/cm$^2$–3.00 g/cm$^2$ with the vertical pressure of 128.4 g/cm$^2$ and a method for providing such a developer that powder layer thereof has a shear index of 1.02–5.00.

In one of the methods, as described in the foregoing with respect to Embodiment 1, the developer T to be accommodated in the toner supply container 1 of present invention is externally acted on with at least one of hydrophobic silica fine particle, alumina fine particle and oxide titanium fine particle, which has a primary particle average particle size of 1–100 nm, as a flowability application material effective to suppress the agglomerativeness and the adherence of the developer.

By the addition of the flowability application material so as to provide a proper surface coverage ratio, the stabilized chargeability can be maintained for a long term even under high temperature and high humidity conditions, so that agglomeration of the toner particles can be effectively prevented.

In order to provide the preferable range of the adhering strength and the shear index with a predetermined pressure applied thereto, it is preferable to control the configurations of the toner in the developer, in addition to the addition of the flowability application material to the developer, to reduce the contact area between the toner particles so as to reduce the attraction between the toner particles.

As for the method of controlling the configuration of the toner particles so as to provide the adhering strength of a powder layer thereof to be 0.60 g/cm$^2$–3.00 g/cm$^2$ with the normal pressure of 128.4 g/cm$^2$, the toner in the developer contains not less than 80% and not more than 100% of the toner particles having a toner circularity a, as defined by equation (3), of not less than 0.900, and further preferably the toner contains, in addition to the above, not less than 67% and not more than 100% (on the basis of numbers) of the toner particles having the toner circularity of not less than 0.95.

$$\text{Circularity } a = L0/L \quad (3),$$

where LO is the circumferential length of a circle having the same projected area as the particle image; and L is the circumferential length of the particle image.

If the percentage of the toner having the circularity a, which is less than 0.900, is less than 80%, the contact area between the toner particles is large, and therefore, the frictional force between the toner particle is large. Then, with the structure of the developer supply container 1 shown in FIGS. 1 and 2, which does not have a stirring member, toner blocking which may have been formed during transportation, is not easily loosened by a small external force. The blocking may even prevent toner discharge. Furthermore, the toner does not easily slide down on the surface of the inclined projection portion 3*a*, so that feeding of the toner is deteriorated, and the transfer efficiency is adversely influenced.

For the determination of the average circularity, a simple method of expressing the configuration of a particle quantitatively is used. The use is made of a flow-type particle image analyzer, FPLA 1000 (tradename) available from Toa Iyo Denshi Kabushiki Kaisha, Japan. The circularity of the measured particle is determined using the following equation (4). The average circularity is determined by dividing the total sum of the circularities of all of the measured particles by the total number of the measured particles.

$$\text{Circularity } a = LO/L \quad (4),$$

where LO is the circumferential length of a circle having the same projected area as the particle image; and L is the circumferential length of the particle image.

The circularity is an index of a degree of smoothness of the configuration of the toner particle, and it is 1.00 if the toner particle is completely spherical, and it decreases with an increase of the complication of the surface shape. A standard deviation of the distribution of the circularities in the present invention is an index of variation, and a smaller value thereof means a sharper distribution.

The measuring device, FPIA 1000 calculates the circularities of the particles, and the obtained circularities are classified into 61 classes. The average circularity and the circularity standard deviation is calculated using the center values of the divided classes and the frequencies. The difference between the average circularity calculated by this calculation method and the average circularity calculated by directly using the circularities of the particles and the difference between the circularity standard deviation calculated by this calculation method and the circularity standard deviation calculated directly using the circularities of the particles, are negligibly small.

In the present invention, from the standpoint of quick calculation and simplification of calculation, the calculation formula directly using the circularities of the particles, and the calculation method of the FPIA 1000× was used with modification.

More particularly, 0.1–0.5 ml of dispersion material, which is a surfactant, preferably alkylbenzenesulfonic acid salt, is added to 100–150 ml of water from which impurities have been removed, and then, 0.1–0.5 g of a sample to be measured is added thereto. The suspension liquid provided by adding the sample is subjected to a dispersion process for approx. 1–3 minutes using an ultrasonic dispersion machine into a dispersing liquid concentration of 12,000–20,000/$\mu$l. Then, using a flow type particle image measuring device, FPIA 1000 (tradename) is used to measure the circularity distribution of the particles having the corresponding diameter of not less than 0.60 $\mu$m and less than 159.21 $\mu$m.

The measurement method is described in a brochure (June, 1995) of the FPIA 1000 (tradename), available from Toa Iyo Denshi Kabushiki Kaisha, Japan, in an operation manual of the measuring device, and in Japanese Laid-open Patent Application Hei 8-136439. This will be described below.

The sample-dispersed liquid is passed through a passageway (expanding along the direction of flow) of a flat transparent flow cell having a thickness of approx. 200 $\mu$m. A stroboscope and a CCD camera are disposed across the flow cell such that the optical path therebetween crosses the flow cell in the direction of the thickness of the flow cell. When the sample-dispersed liquid flows through the cell, the stroboscope emits light at regular intervals of 1/30sec, and two-dimensional images of the particles are taken in predetermined ranges parallel with the flow cell. From the areas of the two-dimensional image of the particle, the corresponding diameter (the diameter of a phantom circle having the same area) is measured. From the projected areas of the two-dimensional images of the particles and the circumferential length of the projected images, the circularities of the particles are calculated using the circularity calculation formula (4).

The method of providing the circularity a not less than 0.900 (determined in this manner) is not limited to a particular one. For example, in the case of a method wherein at least a binder resin and a coloring material are melted and kneaded, and the kneaded material is cooled and then pulverized (pulverization method), the pulverising apparatus is properly selected.

The pulverising apparatus may be a jet flow type pulverising apparatus, more particularly, a jet flow type pulverizer, and particularly a collision flow type or a mechanical type pulverizer. In an alternative, after the pulverization, the pulverized particles may be improved in the configurations by a hybridizer.

Besides the pulverization method, there is a polymerizing method in which a mixture of a polymerization property monomer, a coloring material, and wax f is polymerized to directly produce toner particles.

Recently, there is an increasing demand for the high speed image forming apparatus. In order to improve the anti-offset property of the toner during the image fixing operation in view of this demand, the toner in the developer is in many cases added with a high parting property material, such as wax or the like is. The toner supply container of the present invention is intended to suit such high speed machines, and the developer accommodated in the container may be added with a wax material as long as the adhering strength and the shear index are within the above-described ranges.

In the case that developer includes toner which is internally added with wax, the content of the wax is preferably 0.520 parts by weight on the basis of 100 parts by weight of the binder resin material of the toner.

If it is less than 0.5 parts by weight, the low temperature fixing property, the anti-blocking property, and the anti-offset property of the developer are adversely influenced irrespective of whether the method is a pulverization method or a polymerization method.

If it exceeds 20 parts by weight in the case of the pulverization method, the wax is dispersed in the binder resin, and it exists at the surface of the toner particles, with the result of high adherence and agglomerativeness of the toner. Additionally, an amount of liberated wax is large, with the result of wax deposition on the inclined projection portion of the developer supply container and on the inner wall of the container, and therefore, the feeding performance of the developer is adversely influenced.

In the case of the polymerization method, unification of the toner particles tends to occur during granulation. Since the toner particles are directly produced by polymerization of the mixture of the polymerization property monomer, the coloring material and the wax, a large amount of the wax is contained in the toner particle. There is liberated wax which is not polymerized, during the production of the toner. Similarly to the toner produced through the pulverization method, the feeding performance of the developer is adversely influenced.

The developer used in the present invention may be magnetic toner internally added with magnetic particles, or non-magnetic toner. It is also applicable to a mixture of toner and carrier particles.

Toner A: non-magnetic toner similar to that of Embodiment 1, containing hydrophobic titanium having an average diameter 5 nm (0.8 parts by weight relative to the total weight), and 5.4 parts-by-weight of wax on the basis of 100 parts by weight of the binder resin material. The toner A is a cyan toner, but the same effects are provided using other color non-magnetic pigments.

(Experiment Example 1)

A developer supply container 1 having the structure shown in FIG. 1 of Embodiment 1 was prepared, and toner A (developer T) was filled into the container at a ratio of 0.43 g/cc (inner volume of the container). The container was rotated at a rotational speed of 17 rpm. The discharging property test was carried out for the developer T. A satisfactory developer discharging performance was confirmed from the initial stage of discharge, and the developer T was used up, and the amount of the remaining developer is very small. There is hardly any developer T remaining deposited on the inner wall of the container.

The container containing the toner A at a ratio of 0.43 g/cc (inner volume of the container) was placed horizontally, and was tapped 1000 times. Thereafter, the same discharging property test was carried out. At the initial stage, there was developer blocking, but the blocking was destroyed soon after the start of rotation of the container 1, and a satisfactory discharging property was confirmed. There was hardly any plugging of the developer T. Substantially all of the developer T was discharging out, and the amount of the remaining developer T was very small, and there was hardly any developer T deposited on the inner wall of the container.

Toner B: the toner A was non-magnetic toner produced by the pulverization method. Toner B is added with magnetic particles and is a magnetic toner. The toner B contains 0, 90 parts by weight of hydrophobic silica having an average diameter of 18 nm on the basis of the total weight, and 8 parts by weight of wax on the basis of 100 parts by weight of the binder resin material.

(Experiment Example 2)

Toner B:

This comprises 100 parts by weight of polyester resin material, 90 parts by weight of magnetic material having an average particle size of 0.4 microns, and 8 parts by weight of wax.

A mixture of these materials is melted and kneaded. After it is cooled, it is coarsely pulverized by a hammer mill. The coarse pulverized material is finely pulverized by a jet mill, and the finely pulverized material is classified by an air blow classifier to provide magnetic toner having a volume average diameter 7.3 microns.

Into 100 parts by weight toner powder, 0.90 parts by weight of hydrophobic silica having an average diameter of 18 nm is externally added using a Henschel mixer, thus providing toner B.

A developer supply container 1 having the structure of Embodiment 1 was prepared, and toner B (developer T) was filled into the container at a ratio of 0.60 g/cc (inner volume of the container). The container was rotated at a rotational speed of 17 rpm. The discharging property test was carried out for the developer T. A satisfactory developer discharging performance was confirmed from the initial stage of discharge, and the developer T was used up, and the amount of the remaining developer was very small. There is hardly any developer T remaining deposited on the inner wall of the container.

The container containing the toner A at the ratio of 0.60 g/cc was placed horizontally, and was tapped 1000 times. Thereafter, the same discharging property test was carried out. At the initial stage, there was developer blocking, but the blocking was destroyed soon after start of rotation of the container 1, and a satisfactory discharging property was confirmed. There was hardly any plugging of the developer T. Substantially all of the developer T was discharged out, and the amount of the remaining developer T was very small, and there was hardly any developer T deposited on the inner wall of the container 1.

Toner C: toner A and toner B are produced by the pulverization method, but toner C was non-magnetic toner produced by polymerization method. It comprises 1.0 parts by weight of hydrophobic silica, and 9.80 parts by weight of wax on the basis of 100 parts by weight of the binder resin.

With respect to the toner produced by the polymerization method, the amount of the wax is preferably 0.520 parts by weight on the basis of 100 parts by weight of the binder resin of the toner.

(Experiment Example 3)

A description will be provided as to a method of producing the toner C. Into 710 parts of ion exchange water, 450 parts of 0.1 M-$Na_3PO_4$ aqueous solution are added, and it is heated up to 60° C., and is stirred by a Homomixer which is rotated at 1300 rpm. Then, 68 parts of 1.0 M-$CaCl_2$ aqueous solution were gradually added thereto to provide an aqueous solvent of pH6 containing $Ca_3(PO_4)_2$.

160 parts by weight of styrene;

34 parts by weight of n-butylacrylate 12 parts by weight of copper phthalocyanine pigment;

2 parts by weight of electrification control material;

10 parts by weight of saturated polyester; and 20 parts by weight of wax.

The material was heated up to 60° C., and was uniformly dissolved and dispersed using a Homomixer. On the other hand, polymerization initiator is dissolved to prepare a polymerization property monomer composition. The polymerization property monomer composition was added into the aqueous solvent, and it was stirred for 10 minutes by a Kurea mixer under 60° C. $N_2$ conditions, thus producing a granulated polymerization property monomer composition. Thereafter, a polyreaction was carried out while stirring the aqueous solvent by a stirring paddle blade.

The material was cooled after the polyreaction, and salt acid was added thereto to such an extent that the pH becomes 2, and calcium phosphate is dissolved thereto. Then, the material was filtered, washed with water and dried, thus providing polymerization particles (toner particles).

To 100 parts of the resultant polymerization particles (toner particles), 1.0 parts by weight of hydrophobic silica having a primary particle diameter of 50 nm was externally added to provide the toner C.

A developer supply container 1 having the structure shown in FIG. 1 of Embodiment 1 was prepared, and toner C. (developer) was filled into the container at a ratio of 0.46 g/cc. The container was rotated at a rotational speed of 17 rpm. The discharging property test was carried out for the developer T. A satisfactory developer discharging performance was confirmed from the initial stage of discharge, and the developer T was used up, and the amount of the remaining developer was very small. There was hardly any developer T remaining deposited on the inner wall of the container.

The container containing the toner C at a ratio of 0.46 g/cc was placed horizontally, and was tapped 1000 times. Thereafter, the same discharging property test was carried out. At the initial stage, there was developer blocking, but the blocking was destroyed soon after the start of rotation of the container 1, and a satisfactory discharging property was confirmed. There was hardly any plugging of the developer T. Substantially all of the developer T was discharged out, and the amount of the remaining developer T was very small, and there was hardly any developer T deposited on the inner wall of the container 1.

Toner D: this toner is magnetic toner produced by a pulverization method and having oxide iron (magnetic particles) added thereto. It is added to 10 parts by weight of hydrophobic silica having an average diameter of 10 nm and with 6.86 parts by weight of wax on the basis of 100 parts by weight of binder resin material.

In the case that developer accommodated in the developer supply container is magnetic toner, the magnetic particles are preferably made of magnetic oxide of iron particles having a number average particle diameter of 0.1–1.0 $\mu$m.

In the case of the magnetic oxide of iron, if the diameter is not more than 0.1 $\mu$m, the magnetic particles per se agglomerate with the result of deterioration of the dispersion of the magnetic particles in the toner particles, therefore enhancing the agglomerativeness of the toner.

If it is not less than 1.00 $\mu$m on the contrary, the dispersion of the magnetic particles in the toner deteriorates, with the result of maldistribution of the magnetic particles on the surfaces of the toner particles, and therefore, magnetic agglomeration. Therefore, the agglomerativeness of the toner is enhanced.

The number average particle size of the magnetic particles is measured in the following manner.

An enlarged photograph is taken using a transmission electron microscope with an enlargement magnification of 40,000, and 300 magnetic particles are selected at random, and then, the number average diameter is determined using a digitizer.

(Experiment Example 4)

Toner D is produced in the following manner.

100 parts by weight of hybrid resin component including polyester unit and vinyl polymer unit;

2 parts by weight of a polymer having sulfonate base;

1 part by weight of electrification control material;

7 parts by weight of wax.

100 parts by weight of magnetic oxide of iron having an average particle size of 0. 18 $\mu$m A mixture of these materials is preliminarily mixed by a powder mixing machine and is heated and kneaded by a biaxial extruder. The melting and kneaded material is cooled and it is coarsely pulverized into approx. 1–2 mm particles by a hammer mill, and then the particles are finely pulverized by a mechanical pulverized. The fine particles are classified by a classifying apparatus into multiple classes with strict removal of the too fine or coarse powder, so that magnetic toner particles are produced.

Into 100 parts by weight magnetic toner powder, 1.0 parts by weight of hydrophobic silica having an average diameter of 10 nm is externally added using a Henschel mixer, thus providing toner D.

A developer supply container 1 having the structure of Embodiment 1 was prepared, and toner D was filled into the container at a ratio of 0.60 g/cc (inner volume of the container). The container was rotated at a rotational speed of 17 rpm. The discharging property test was carried out for the developer T. A satisfactory developer discharging performance was confirmed from the initial stage of discharge, and the developer T was used up, and the amount of the remaining developer was very small. There is hardly any developer T remaining deposited on the inner wall of the container.

The container containing the toner A at the ratio of 0.60 g/cc was placed horizontally, and was tapped 1000 times.

Thereafter, the same discharging property test was carried out. At the initial stage, there was developer blocking, but the blocking was destroyed soon after the start of rotation of the container 1, and a satisfactory discharging property was confirmed. There was hardly any plugging of the developer T. Substantially all of the developer T was discharged out, and the amount of the remaining developer T was very small, and there was hardly any developer T deposited on the inner wall of the container 1.

Two-component developer E

The present invention is applicable to a container accommodating two component developer, and a description will be provided as to a developer supply kit for a two-component developer E comprising the toner A and carrier particles.

In the two-component developing system, a fresh mixture of the carrier and the toner is periodically or continuously fed into the developing device to avoid charging deterioration of the developer. By doing so, the charging deterioration of the developer can be suppressed, or the exchange frequency can be reduced as compared with the case not using that system, or the necessity for the exchange can be eliminated.

In the image forming apparatus of such a structure, the developer accommodated in the developer supply container is a mixture of the toner and the carrier. The developer supply container of the present invention is applicable to such a developer.

The content of the carrier particles is preferably not more than 40% by weight. If it is larger than 40% by weight, the toner and the carrier tend to segregate.

(Experiment Example 5)

The two-component developer E is produced in the following manner. 80 parts by weight of toner A having an average particle size of 45 $\mu$m, and 20 parts by weight of Mn Mg ferrite carrier having a true specific gravity of 5.1, are prepared.

They are preliminarily mixed by a mixing machine to a sufficient extent. Therefore, the content of the carrier is 20% by weight on the basis of the total amount.

The adhering strength of the developer is 2.5 g/cm$^2$.

A developer supply container 1 (for two-component developer E) having the structure shown in FIG. 1 of Embodiment 1 was prepared, and toner A (developer T) was filled into the container at a ratio of 0.45 g/cc (inner volume of the container). The container was rotated at a rotational speed of 17 rpm. The discharging property test was carried out for the developer T. A satisfactory developer discharging performance was confirmed from the initial stage of discharge, and the developer T was used up, and the amount of the remaining developer was very small. There is hardly any developer T remaining deposited on the inner wall of the container.

The mixing ratio of toner and carrier of the discharged developer T was measured at proper interval, and it was confirmed that there is no segregation of the carrier and toner.

The container containing the toner A at a ratio of 0.43 g/cc (inner volume of the container) was placed horizontally with the opening 1*a* facing down, and was tapped 1000 times. Thereafter, the same discharging property test was carried out. At the initial stage, there was developer blocking, but the blocking was destroyed soon after the start of rotation of the container 1, and a satisfactory discharging property was confirmed. There was hardly any plugging of the developer T. Substantially all of the developer T was discharged out, and the amount of the remaining developer T was very small, and there was hardly any developer T deposited on the inner wall of the container 1.

The mixing ratio of toner and carrier of the discharged developer T was measured at a proper interval, and it was confirmed that there was no segregation of the carrier and toner.

(Comparison Example 2)

As a comparison example, toner F which is similar to the toner of comparison example with respect to Embodiment 1 was prepared. The toner F contains 10 parts by weight of wax on the basis of the binder resin but does not contain a flowability application material such as hydrophobic silica, hydrophobic titanium oxide or hydrophobic alumina or the like which was added to the toner A, B, C. and D.

(Experiment Examples 1–4).

A developer supply container 1 having the structure shown in FIG. 1 of Embodiment 1 was prepared, and toner A (developer T) was filled into the container at a ratio of 0.43 g/cc (inner volume of the container). The container was rotated at a rotational speed of 17 rpm. The discharging property test was carried out for the developer T. Not less than approx. 10% of the developer T remained unusably. The amount of the developer T remaining deposited on the inner wall of the container 1 is large.

The container containing the toner A at a ratio of 0.43 g/cc (inner volume of the container) was placed horizontally, and was tapped 1000 times. Thereafter, the same discharging property test was carried out. The block was not loosened until the container 1 was rotated for not less than 5. The discharging speed was still slow even after the block was loosened, and the discharging property was not good.

Table 1 shows the deposition strengths, the shear indices and the circularities of the toner A, B, C, D and toner F used in experiment examples 1–5 and comparison example 1:

TABLE 1

| | adhering strength (g/cm$^2$) | shears indices | ratio of particles having circularity ≧0.900 |
|---|---|---|---|
| Toner A | 2.3 | 3.37 | 82% |
| Toner B | 1.4 | 2.56 | 86% |
| Toner C | 0.75 | 1.2 | 97% |
| Toner D | 0.75 | 1.04 | 98% |
| Toner E | 3.8 | 6.9 | 74% |

From the comparison of the results of experiment examples 1–5 and comparison example 2 with Table 1, it is understood that it is preferable that the adhering strength of the powder layer of the developer with the vertical pressure of 128.4 g/cm$^2$ is in the range of 0.60 g/cm$^2$–3.00 g/cm$^2$.

The toner F which has an adhering strength and a shear index outside the range exhibits less than 80 percentage of the toner having the toner circularity of not less than 0.900. The experimental results of such toner are no good, as will be understood from comparison example 2. From this, it is understood that not less than 80% of the toner having a circularity not less than 0.900 is one of important factors to provide the adhering strength and/or the shear index of the developer in the range according to the present invention.

The method of aligning the circularity may be a pulverization method or polymerization method and is applicable to non-magnetic toner and magnetic toner.

As described with respect to Experiment 1–5, the toner A–D is added to flowability application material, such as hydrophobic silica, hydrophobic titanium oxide, or hydrophobic alumina or the like, having an average particle size of a primary particle which is 1–100 nm. However, the toner F is not added with such a material. It is therefore understood that the addition of such a flowability application material to the developer is important, since then, the shear index and/or the adherence index can be lowered into the range according to the present invention.

From the foregoing, it is understood that if the adhering strength of the powder layer of the developer with the vertical pressure of 128.4 g/cm$^2$ is in the range of 0.60 g/cm$^2$–3.00 g/cm$^2$, the function of the developer supply container 1 is effectively performed, so that feeding performance and the discharging property for the developer is improved.

In order to adjust the deposition strength and the shear index within the range, the flowability application material such as the hydrophobic silica, the hydrophobic titanium oxide, the hydrophobic alumina or the like having a primary particle average particle size of 1–100 nm may be added, or the number basis cumulative value of the particles having a circularity a, which is not less than 0.900, is made not less than 80%.

In addition, as has been described with respect to said experiment examples 1–5, in the developer supply kit using toner A-toner E, the powder layer of the developer has the shear index 1.02–5.00 when the vertical pressure is 128.4 g/cm$^2$, and therefore, the above-described advantageous effects are stabilized.

(Embodiment 3)

Figure 6:
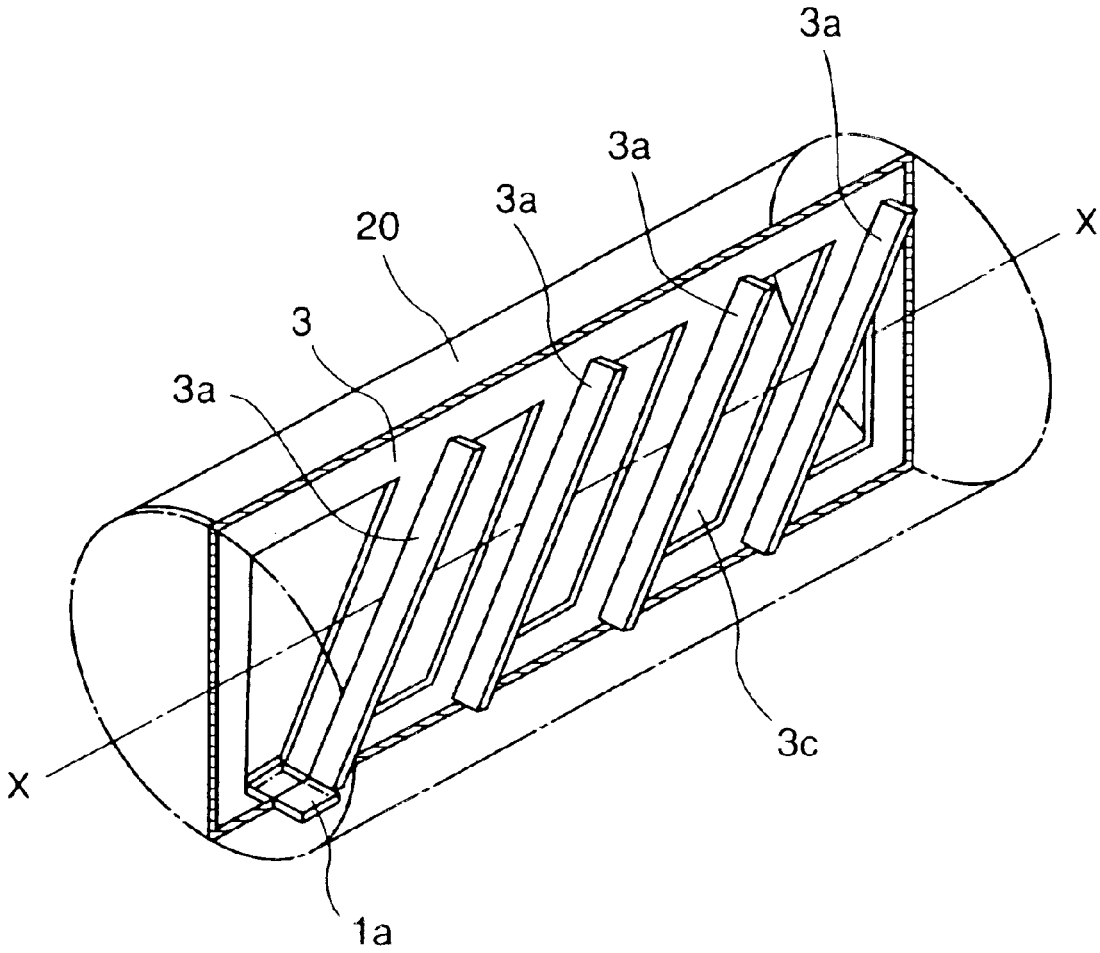
FIG. 6 is a perspective view of a partial section of another example of the developer supply container according to the present invention.
Figure 7:
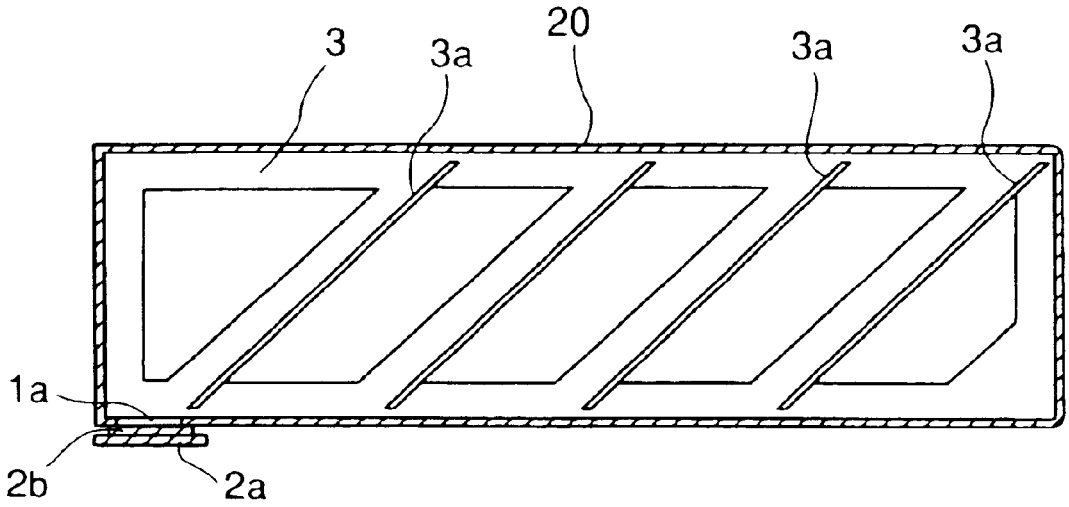
FIG. 7 is a longitudinal sectional view of a further example of the developer supply container.

This embodiment uses a developer supply container 20 having a structure shown in FIGS. 6 and 7. FIG. 6 is a perspective view of a partial section of the developer supply container 20 according to this embodiment of the present invention, and FIG. 7 is a sectional view taken along an axis.

A description will be provided as to the internal structure of the container 20.

The developer supply container is in the form of a toner bottle 20 which is substantially cylindrical, and is substantially disposed horizontally in the image forming apparatus 100, and the bottle 1 (main body) of the container is rotated by the main assembly 100 of the apparatus, similarly to Embodiment 1.

In the bottle 20, a partition wall 3 (feeding member) is extended substantially the full length of the container so as to divide the inside space into two parts. The opposite sides of the partition wall 3 are provided with a plurality of projections 3*a* disposed in a mirror symmetric relation with respect to the rotational axis X—X of the main body 1 of the container, the projection 3*a* having surfaces inclined relative to the direction of the axis. As shown in FIG. 6, the projections 3*a* are arranged on the front and back surfaces of the partition wall 3 symmetrically with respect to the rotational axis XX such that developer is fed by a unidirectional rotation.

In this embodiment, the opening 1*a* is provided in a peripheral surface of the container. The opening 1*a* is provided with a sealing member 2 for plugging the opening 1*a*, and the sealing member 2 is slidable relative to the toner bottle 20 in an axial direction indicated by an arrow to open and close the opening 1*b*. The sealing member 2 comprises an arcuate shutter 2*a* conformed to the outer periphery of the main body 20 and a gasket or packing material 2*b* attached to the inner surface of the shutter 2*a*.

The sealing member 2 is mounted to the main body 20 so as to be reciprocable between a position in which the opening 1*a* of the main body 20 of the container is closed and a position in which it is opened. More particularly, rails parallel with the shutter 2*a* are provided, and parallel guide portions are provided around the opening 1*a* of the main body 20, and they are engaged with each other.

The sealing member 2 may be movable in a direction along the circumferential surface of the main body 20 of the container or along the rotational axis X—X of the main body 20. The latter is convenient, because the sealing member 2 can be closed or opened using the container inserting motion.

The packing member 2*b* is preferably made of polyurethane foam, and it is fixed on the shutter 2*a* by double coated tape. The gasket may be of another foam member, rubber, or another elastic member. The fixing means is not limited to the double coated tape, but any known method is usable. When the sealing member 2 is mounted to the main body of the container, the gasket 2*b* is compressed to a predetermined extent to hermetically seal the opening 1*a*.

As described, the present invention is applicable to the structure in which the opening is formed in a peripheral surface with the same advantageous effects as Embodiment 1. When the developing device 201 is disposed right below the container as in the image forming apparatus 100 shown in FIG. 8, the developer can be directly supplied into the developing device, and therefore, there is no need to provide a feeding path for connecting the developing device and the developer supply container.

Also in this embodiment, if the adhering strength of a powder layer of the developer is in the range of 0.60 g/cm$^2$–3.00 g/cm$^2$ when the vertical pressure is 128.4 g/cm$^2$, the above-described advantageous effects are provided irrespective of whether the toner is produced by a pulverization method or polymerization method, whether the toner is non-magnetic or magnetic, whether the developer contains carrier or not.

As described in the foregoing, by the adhering strength of 0.60 g/cm$^2$–3.00 g/cm$^2$ when the vertical pressure is 128.4 g/cm$^2$, the developer feeding power is good substantially throughout the using duration of the repeatedly usable developer supply container from the beginning to the end, without a high cost, and the production of coarse particles.

The amounts of the developer unusably remaining in the developer supply container or the developer deposited unusably on the inner wall of the container are very small, and therefore, substantially all of the developer in the developer supply container can be used up. Even when the developer is agglomerated or caked in the main assembly of the developer supply container due to vibration during transportation or due to long term storage under the high temperature and high humidity conditions, the developer is sufficiently loosened, and the feeding power can be maintained. Thus, the scattering of the developer or contamination with the developer adjacent the opening of the developer supply container can be minimized. The plugging of the opening of the developer supply container with the developer can be avoided. Such a developer supply kit can be provided.

While the invention has been described with reference to the structures disclosed herein, it is not confined to the details set forth and this application is intended to cover such modifications or changes as may come within the purpose of the improvements or the scope of the following claims.

What is claimed is:

1. A developer supply kit for supplying a developer to an image forming apparatus, said developer supply kit comprising:

a container configured to accommodate a developer, wherein said container includes an opening to permit discharging of the developer;

a feeding member, provided in said container, configured and positioned to feed the developer by rotation thereof;

wherein said feeding member includes:

a lift portion configured and positioned to lift the developer in said container;

a guiding portion configured and positioned to guide the developer lifted by said lift portion downwardly toward said opening; and a fall-permitting portion configured and positioned to permit the developer lifted by said lift portion to fall without feeding the developer toward the opening with rotation of said feeding member, wherein the developer has an adhering strength which is not less than 0.60 g/cm$^2$ and less than 3.00 g/cm$^2$ after a vertical pressure of 128.4 g/cm$^2$ is imparted to a layer of the developer.

2. A kit according to claim 1, wherein the shear index of the developer after the vertical pressure is imparted is not less than 1.02 and less than 5.00.

3. A kit according to claim 1 or 2, further comprising a plate member comprising a plurality of said lift portions and a plurality of said fall-permitting portions.

4. A kit according to claim 3, wherein said fall-permitting portions are through-holes formed in said plate member.

5. A kit according to claim 4, wherein said guiding portion includes a plurality of projected portions inclined with respect to a rotation axis toward the opening.

6. A kit according to claim 5, wherein an end of one of said projected portions reaches the opening.

7. A kit according to claim 3, wherein said lift portions and said fall-permitting portions are provided on each side of said plate member.

8. A kit according to claim 7, wherein said fall-permitting portions are through-holes formed in said plate member.

9. A kit according to claim 8, wherein said guiding portion includes a plurality of projected portions, inclined with respect to a rotation axis toward the opening, on the side of said plate member.

10. A kit according to claim 9, wherein said feeding member is configured and positioned to feed the developer toward the opening by its rotation in one rotational direction.

11. A kit according to claim 10, an end of one of said projected portions reaches the opening at one side of said plate member.

12. A kit according to claim 1 or 2, wherein said feeding member is rotatable integrally with said container.

13. A developer supply kit for supplying a developer to an image forming apparatus, said developer supply kit comprising:

a container configured to accommodate a developer and including an opening to permit discharging of the developer;

a feeding member, provided in said container, configured and positioned to feed the developer by rotation thereof;

wherein said feeding member includes:

a lift portion configured and positioned to lift the developer in said container;

a guiding portion configured and positioned to guide the developer lifted by said lift portion downwardly toward the opening; and a fall-permitting portion configured and positioned to permit the developer lifted by said lift portion to fall without feeding it toward the opening with rotation of said feeding member; and wherein the shear index of the developer after a vertical pressure of 128.4 g/cm$^2$ is imparted to a layer of the developer is not less than 1.02 and less than 5.00.

14. A kit according to claim 13, further comprising a plate member comprising a plurality of said lift portions and a plurality of said fall-permitting portions.

15. A kit according to claim 14, wherein said fall-permitting portions are through-holes formed in said plate member.

16. A kit according to claim 14 or 15, wherein said guiding portion includes a plurality of projected portions inclined with respect to a rotation axis toward the opening.

17. A kit according to claim 16, wherein an end of one of said projected portions reaches the opening.

18. A kit according to claim 14, wherein said lift portions and said fall-permitting portions are provided on each side of said plate member.

19. A kit according to claim 18, wherein said fall-permitting portions are through-holes formed in said plate member.

20. A kit according to claim 18 or 19, wherein said guiding portion includes a plurality of projected portions inclined with respect to a rotation axis toward the opening, on the side of said plate member.

21. A kit according to claim 20, wherein said feeding member is configured and positioned to feed the developer toward the opening by its rotation in one rotational direction.

22. A kit according to claim 21, wherein an end of one of said projected portions reaches said plate member.

23. A kit according to claim 13, wherein said feeding member is rotatable integrally with said container.

24. A developer supply kit for supplying a developer to an image forming apparatus, said developer supply kit comprising:

a rotatable container configured to accommodate a developer;

an opening provided in said container to permit discharging of the developer; and a feeding member, provided in said container, configured and positioned to feed the developer in said container toward said opening by integral rotation thereof with said container, wherein said feeding member includes a rotatable plate-like member extending in a longitudinal direction of said container, said plate-like member including a projection which is inclined relative to a rotational axis thereof to guide the developer substantially downwardly toward said opening with rotation thereof, and a through hole effective to let the developer on said plate-like member fall with rotation thereof, thus stirring the developer, wherein the developer has an adhering strength which is not less than 0.60 g/cm$^2$ and less than 3.00 g/cm$^2$ after a vertical pressure of 128.4 g/cm$^2$ is imparted to a layer of the developer.

25. A kit according to claim 24, wherein the shear index of the developer after the vertical pressure is imparted is not less than 1.02 and less than 5.00.

26. A kit according to claim 24, further comprising a plurality of said projections provided at longitudinally different positions on one side of said plate-like member.

27. A kit according to claim 24, further comprising a plurality of said projections provided at longitudinally different positions on both sides of said plate-like member.

28. A kit according to claim 27, wherein said projections are provided on both sides of said plate-like member so as to effect a developer discharging action twice for one full rotation of said plate-like member.

29. A kit according to claim 26, 27 or 28, wherein one of said plurality of projections is substantially close to or contiguous with said opening.

30. A kit according to claim 29, further comprising a hollow extension extending from said opening, said extension having an opening at a free end thereof to permit discharge of the developer.

31. A kit according to claim 26, 27 or 28, wherein said plurality of said projections are provided so as to be partly overlapped with respect to the longitudinal direction of said plate-like member.

32. A kit according to claim 26, 27 or 28, wherein said through hole is provided between each of adjacent projections.

33. A kit according to claim 24, wherein said plate-like member extends substantially along the length of said container.

34. A kit according to claim 24, wherein said plate-like member diametrically divides the inside of said container into two substantially equal parts.

35. A developer supply kit for supplying a developer to an image forming apparatus, said developer supply kit comprising:

a rotatable container configured to accomodate a developer; and an opening provided in said container to permit discharging of the developer; and a feeding member, provided in said container, configured and positioned to feed the developer in said container toward said opening by integral rotation thereof with said container, wherein said feeding member includes a rotatable plate-like member extending in a longitudinal direction of said container, said plate-like member including a projection which is inclined relative to a rotation axis thereof to guide the developer substantially downwardly toward said opening with rotation thereof, and a through hole effective to let the developer on said plate-like member fall with rotation thereof, thus stirring the developer, wherein a shear index of the developer after the vertical pressure is imparted is not less that 1.02 and less than 5.00.

36. A kit according to claim 35, further comprising a plurality of said projections provided at longitudinally different positions on one side of said plate-like member.

37. A kit according to claim 35, further comprising a plurality of said projections provided at longitudinally different positions on both side of said plate-like member.

38. A kit according to claim 37, wherein said projections are provided on both sides of said plate-like member so as to effect a developer discharging action twice for one full rotation of said plate-like member.

39. A kit according to claim 36, 37 or 38, wherein one of the plurality of projections is substantially close to or contiguous with said opening.

40. A kit according to claim 39, further comprising a hollow extension extending from said opening, said extension having an opening at a free end thereof to permit discharge of the developer.

41. A kit according to claim 36, 37, or 38, wherein said plurality of said projections are provided so as to be partially overlapped with respect to the longitudinal direction of said plate-like member.

42. A kit according to claim 36, 37, or 38, wherein said through hole is provided between each of adjacent projections.

43. A kit according to claim 35, wherein said plate-like member extends substantially along the length of said container.

44. A kit according to claim 35, wherein said plate-like member diametrically divides the inside of said container into two substantially equal parts.

* * * * *